US011867391B2

(12) United States Patent
Janvier

(10) Patent No.: US 11,867,391 B2
(45) Date of Patent: Jan. 9, 2024

(54) DYNAMIC HEAT RELEASE CALCULATION FOR IMPROVED FEEDBACK CONTROL OF SOLID-FUEL-BASED COMBUSTION PROCESSES

(71) Applicant: ENERO SOLUTIONS INC., Montreal (CA)

(72) Inventor: Benoit Janvier, Pointe-Claire (CA)

(73) Assignee: ENERO INVENTIONS INC., Montreal (CA)

( * ) Notice: Subject to any disclaimer, the term of this patent is extended or adjusted under 35 U.S.C. 154(b) by 280 days.

(21) Appl. No.: 16/646,356

(22) PCT Filed: Sep. 11, 2018

(86) PCT No.: PCT/CA2018/051119
§ 371 (c)(1),
(2) Date: Mar. 11, 2020

(87) PCT Pub. No.: WO2019/046972
PCT Pub. Date: Mar. 14, 2019

(65) Prior Publication Data

US 2020/0271311 A1 Aug. 27, 2020

Related U.S. Application Data

(60) Provisional application No. 62/557,120, filed on Sep. 11, 2017.

(51) Int. Cl.
*F22B 35/18* (2006.01)
*F23B 30/02* (2006.01)
(Continued)

(52) U.S. Cl.
CPC ..... *F22B 35/18* (2013.01); *F23B 30/02* (2013.01); *F23B 40/06* (2013.01); *F23G 5/50* (2013.01);
(Continued)

(58) Field of Classification Search
CPC .... F23G 5/50; F23G 2207/10; F23G 2209/00; F23G 2209/26; F23G 2209/261;
(Continued)

(56) References Cited

U.S. PATENT DOCUMENTS 4,870,912 A * 10/1989 Lee ..... F23N 1/022 110/190
6,145,453 A * 11/2000 Martin ..... F23G 5/50 110/291
(Continued)

FOREIGN PATENT DOCUMENTS

CA 2121295 C 2/2000
EP 0754907 A2 1/1997
(Continued)

OTHER PUBLICATIONS

Sarkar, P. et al., "Data-Reconciliation Based Fault-Tolerant Model Predictive Control for a Biomass Boiler", Energies 10.2 (2017): 194.
(Continued)

*Primary Examiner* — Alfred Basichas
(74) *Attorney, Agent, or Firm* — NORTON ROSE FULBRIGHT CANADA LLP

(57) ABSTRACT

The present disclosure provides methods and systems for modulating a solid-fuel-based combustion process. A current instantaneous heat release for a solid-fuel-based heat generator is determined at a virtual sensor. The current instantaneous heat release is compared to a current firing rate demand. When the current instantaneous heat release does not correspond to the current firing rate demand, an underfire air flow of the heat generator is adjusted.

16 Claims, 5 Drawing Sheets

(51) Int. Cl.

| | |
|---|---|
| ***F23B 40/06*** | (2006.01) |
| ***F23G 5/50*** | (2006.01) |
| ***F23G 7/10*** | (2006.01) |
| ***F23L 1/02*** | (2006.01) |
| ***F23L 9/02*** | (2006.01) |
| ***F23N 1/02*** | (2006.01) |

(52) U.S. Cl.
CPC ..... *F23G 7/10* (2013.01); *F23L 1/02* (2013.01); *F23L 9/02* (2013.01); *F23N 1/022* (2013.01); *F23G 2207/10* (2013.01); *F23G 2207/30* (2013.01)

(58) Field of Classification Search
CPC ..... F23G 2209/262; F23G 2209/28; F23G 2207/101; F23G 2207/102; F23G 7/10; F23G 2207/30; F23N 2241/18; F23N 3/00; F23N 1/022; F23B 40/06; F23B 30/02; F23L 9/02; F23L 1/02; F22B 35/18
USPC ..... 431/12
See application file for complete search history.

(56) References Cited

U.S. PATENT DOCUMENTS

| | | | | |
|---|---|---|---|---|
| 6,655,304 | B1 | 12/2003 | Barlow | |
| 6,868,368 | B1 | 3/2005 | Lang | |
| 7,638,070 | B2 | 12/2009 | Johnson et al. | |
| 7,854,775 | B2 | 12/2010 | Surma et al. | |
| 7,909,899 | B2 | 3/2011 | Diebold et al. | |
| 8,616,294 | B2 | 12/2013 | Zubrin et al. | |
| 9,039,407 | B2 | 5/2015 | McKnight et al. | |
| 9,074,152 | B2 | 7/2015 | Nielsen et al. | |
| 9,321,640 | B2 | 4/2016 | Tsangaris et al. | |
| 9,353,945 | B2 * | 5/2016 | Gross | F23N 1/022 |
| 9,657,946 | B2 * | 5/2017 | Young | F23N 1/022 |
| 2009/0142717 | A1 * | 6/2009 | Lavelle | F23N 5/006 700/274 |
| 2010/0101462 | A1 | 4/2010 | Hayashi et al. | |
| 2010/0154304 | A1 * | 6/2010 | Tsangaris | F23G 5/027 48/74 |
| 2012/0285080 | A1 | 11/2012 | Despen et al. | |
| 2013/0011803 | A1 | 1/2013 | Siemons | |
| 2013/0247448 | A1 | 9/2013 | Ampulski et al. | |
| 2014/0107993 | A1 * | 4/2014 | Cheng | G05B 17/02 700/32 |
| 2014/0241949 | A1 | 8/2014 | Perkins et al. | |
| 2016/0054730 | A1 | 2/2016 | Lou et al. | |
| 2016/0283254 | A1 * | 9/2016 | Hill | G06F 9/44552 |

FOREIGN PATENT DOCUMENTS

| | | | | |
|---|---|---|---|---|
| EP | 1726876 | A1 | 11/2006 | |
| JP | 63091402 | | 4/1988 | |
| JP | 09273733 | | 10/1997 | |
| JP | 2007010258 | | 1/2007 | |
| JP | 2017096517 | | 1/2007 | |
| JP | 5996762 | | 9/2016 | |
| WO | 03025459 | | 3/2003 | |
| WO | 03025459 | A1 | 3/2003 | |
| WO | 2006128285 | A1 | 12/2006 | |
| WO | 2014191865 | | 12/2014 | |
| WO | 2014191865 | A1 | 12/2014 | |
| WO | WO-2014191865 | A1 * | 12/2014 | F23G 5/002 |
| WO | 2015145328 | A2 | 10/2015 | |
| WO | 2016046699 | A1 | 3/2016 | |

OTHER PUBLICATIONS

Paulsson, D. et al., "A Soft Sensor for Bioprocess Control Based on Sequential Filtering of Metabolic Heat Signals", Sensors 14.10 (2014): 17864-17882.

International Search Report and Written Opinion dated Dec. 3, 2018 in connection with international application No. PCT/CA2018/051119.

Search Report dated Apr. 23, 2021 in connection with corresponding EP application No. 18853702.1.

* cited by examiner

DYNAMIC HEAT RELEASE CALCULATION FOR IMPROVED FEEDBACK CONTROL OF SOLID-FUEL-BASED COMBUSTION PROCESSES

CROSS-REFERENCE TO RELATED APPLICATION

The present application claims priority under 35 USC § 119(e) of provisional patent application bearing Ser. No. 62/557,120 filed on Sep. 11, 2017, the contents of which are hereby incorporated by reference.

TECHNICAL FIELD

The present disclosure relates to heat generators, and more specifically to biomass-based heat generator control.

BACKGROUND

Solid fuels, such as biomass, wastes, or coal, have long been used as a source of fuel for energy generation. Traditionally, solid fuel is combusted in an enclosed or semi-enclosed space, and the combustion of the solid fuel generates energy in the form of heat. In more recent history, efforts toward green energy, energy efficiency, and waste reduction have led to a resurgence of solid-fuel-based energy generation. A modern solid-fuel heat generator combusts solid fuel in a furnace or other enclosure, and the heat produced by the combustion and pyrolysis is used to generate steam. The steam is used to deliver heat to heat sinks, or fed through a turbine to generate power, or used to produce other useful work.

Due to characteristics inherent to solid fuels, the combustion process of solid fuels is somewhat irregular and unpredictable. Indeed, unlike gaseous fuels where the combustion reactions are rapid because of intimate gas-to-air mixing, solid fuel burning is slower and less predictable due to varying degrees of moisture content, density, surface-area-to-volume ratio, exposed fuel-to-air surface area, chemical composition, and the like. In addition, the feeding process of solid fuel into the heat generator is often irregular, and may lead to spikes or dips in heat production. These characteristics vary over time, cannot typically be measured accurately with sensors, and will change throughout the combustion process, making it very difficult to maintain the heat release at its desired target. Because of these difficult combustion dynamics, traditional solid-fuel heat generator control strategies are designed to respond to variations in heat release by modulating the fuel input of solid fuel to the heat generator. Modulation of fuel input will result in a slow correction in heat release, making it very difficult to maintain the generator heat release at its target and forcing the system to rely on other faster actuators for total process heat balance, such as steam condensing, steam venting, and supplementary gas firing.

As such, there is a need for improved solid-fuel heat generator controls.

SUMMARY

The present disclosure is drawn to methods and systems for modulating a solid-fuel-based combustion process.

In accordance with a broad aspect, there is provided a method for modulating a solid-fuel-based combustion process. A current instantaneous heat release for a solid-fuel-based heat generator is determined at a virtual sensor. The current instantaneous heat release is compared to a current firing rate demand. When the current instantaneous heat release does not correspond to the current firing rate demand, an underfire air flow of the heat generator is adjusted.

In some embodiments, the current instantaneous heat release is based on a flow rate of steam produced by the heat generator and a pressure change in the heat generator.

In some embodiments, the current instantaneous heat release is further based on at least one of a composition of a flue gas output by the heat generator, a temperature profile for the heat generator, a heat transfer differential measured between first and second points within the heat generator, and a parameter of a water drum associated with the heat generator.

In some embodiments, the method further comprises adjusting an overfire air flow of the heat generator when the level of fluctuation does not correspond to the current firing demand.

In some embodiments, the method further comprises adjusting a rate of fuel flow to the heat generator when the level of fluctuation does not correspond to the current firing demand.

In some embodiments, the method further comprises adjusting a rate of vibration of a grate of the heat generator when the level of fluctuation does not correspond to the current firing demand.

In some embodiments, comparing the current instantaneous heat release to a current firing rate demand comprises determining whether the current instantaneous heat release is beyond a predetermined tolerance; and the current instantaneous heat release not corresponding to the current firing demand comprises the difference being beyond the predetermined tolerance.

In some embodiments, the method further comprises receiving the firing rate demand.

In some embodiments, the method further comprises: receiving a subsequent firing rate demand; determining a subsequent instantaneous heat release; comparing the subsequent instantaneous heat release with the subsequent firing rate demand; and when the subsequent instantaneous heat release does not correspond to the subsequent current firing demand, adjusting the underfire airflow of the heat generator.

In some embodiments, determining the instantaneous heat release is further based on the at least one previously-determined instantaneous heat release.

In accordance with another broad aspect, there is provided a system for modulating a solid-fuel-based combustion process. The system comprises a processing unit and a non-transitory computer-readable memory. The computer-readable memory has stored thereon program instructions executable by the processing unit for determining, at a virtual sensor, a current instantaneous heat release of a solid-fuel-based heat generator; comparing the current instantaneous heat release to a current firing rate demand; and when the current instantaneous heat release does not correspond to the current firing rate demand, adjusting an underfire air flow of the heat generator.

In some embodiments, the current instantaneous heat release is based on a flow rate of steam produced by the heat generator and a pressure in the heat generator.

In some embodiments, the current instantaneous heat release is further based on at least one of a composition of a flue gas output by the heat generator, a temperature profile for the heat generator, a heat transfer differential measured between first and second points within the heat generator, and a parameter of a water drum associated with the heat generator.

In some embodiments, the program instructions are further executable for adjusting an overfire air flow of the heat generator when the level of fluctuation does not correspond to the current firing demand.

In some embodiments, the program instructions are further executable for adjusting a rate of fuel flow to the heat generator when the level of fluctuation does not correspond to the current firing demand.

In some embodiments, the program instructions are further executable for adjusting a rate of vibration of a grate of the heat generator when the level of fluctuation does not correspond to the current firing demand.

In some embodiments, comparing the current instantaneous heat release to a current firing rate demand comprises determining whether the current instantaneous heat release is beyond a predetermined tolerance; and the current instantaneous heat release not corresponding to the current firing demand comprises the difference being beyond the predetermined tolerance.

In some embodiments, the program instructions are further executable for receiving the firing rate demand.

In some embodiments, the program instructions are further executable for: receiving a subsequent firing rate demand; determining a subsequent instantaneous heat release; comparing the subsequent instantaneous heat release with the subsequent firing rate demand; and when the subsequent instantaneous heat release does not correspond to the subsequent current firing demand, adjusting the underfire airflow of the heat generator.

In some embodiments, determining the subsequent instantaneous heat release is further based on the at least one previously-determined instantaneous heat release.

Features of the systems, devices, and methods described herein may be used in various combinations, and may also be used for the system and computer-readable storage medium in various combinations

BRIEF DESCRIPTION OF THE DRAWINGS

Further features and advantages of embodiments described herein may become apparent from the following detailed description, taken in combination with the appended drawings, in which.

It will be noted that throughout the appended drawings, like features are identified by like reference numerals.

DETAILED DESCRIPTION

Figure 1:
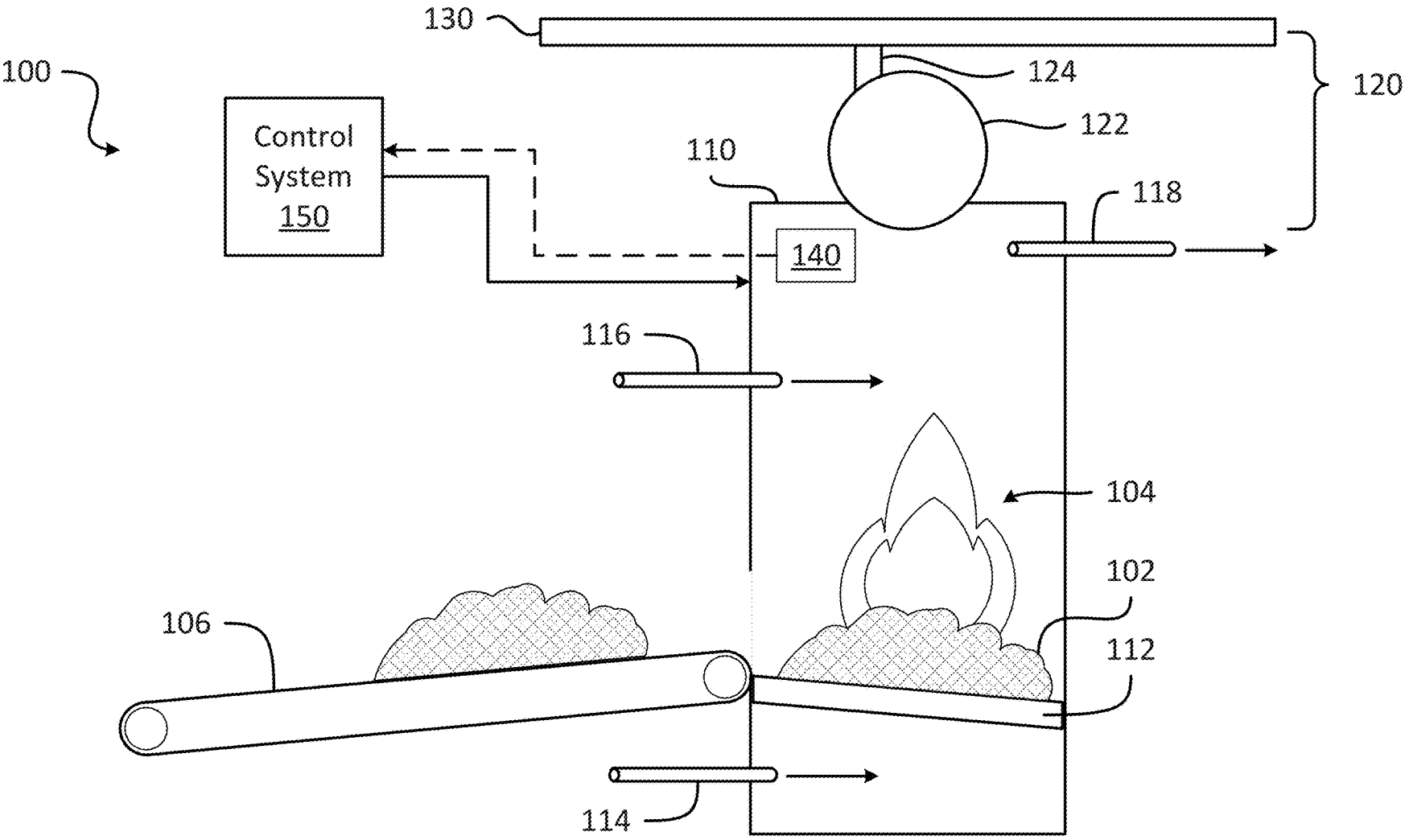
FIG. 1 is a diagram of an example solid-fuel heat generator system.

With reference to FIG. 1, a solid-fuel heat generator system 100 is shown. The solid-fuel heat generator system 100 serves to perform combustion of solid fuel 102, thereby producing heat 104. The solid-fuel heat generator system 100 includes a furnace 110, a boiler 120, and a steam distribution system 130. The furnace 110 and the boiler 120 are coupled such that heat produced within the furnace 110, via the combustion of solid fuel 102, heats water in the boiler 120, producing steam.

The boiler 120 includes a boiler drum 122, which is provided with water for the production of steam via the heating action of the furnace 110 The boiler 120 also includes a steam outlet 124, through which steam produced within the boiler drum 122 exits the boiler drum 122. The boiler 120 and the steam distribution system 130 are coupled so that steam produced within the boiler 120 is routed toward the steam distribution system 130 via the steam outlet 124. The steam distribution system 130 then routes the steam produced by the solid-fuel heat generator system 100 to turbines or other steam-based energy consumers. It should be noted that although the foregoing discussion focuses primarily on steam boilers, the systems and methods described herein may also be applied to hot water boilers, or any other suitable kind of boiler.

The furnace 110 is a substantially-enclosed structure which may be cylindrical, oblong, rectangular, or any other suitable shape. The furnace 110 may be made of any suitable heat-resistant material, for example carbon steel. The furnace 110 has defined therein an opening through which solid fuel 102 is fed to the furnace 110, for example via a conveyor belt 106. The conveyor belt 106 is configured for ferrying solid fuel 102 toward the furnace 110 for combustion. The conveyor belt 106 may be any suitable mechanism for transporting the solid fuel and for depositing it within the furnace 110, for example via the opening in the furnace 110. The conveyor belt 106 may acquire the solid fuel 102 via any suitable mechanism, and may interact with a reserve of solid fuel in any suitable fashion. It should be noted that other approaches for providing fuel to the furnace 110 are also considered.

The furnace 110 has disposed therein a surface grate 112, for example a grate, on which the solid fuel 102 rests for combustion. The surface grate 112 may span the entire width of the furnace 110, and may be angled with respect to a floor of the furnace 110 at any suitable inclination. The surface grate 112 may be made of any suitably heat-resistant material, for example steel, and may be provided with a cooling system using air or water for cooling purposes. In some embodiments, the surface grate 112 has defined therein one or more apertures or holes through which air or other oxidant elements may be directed underneath the solid fuel 102. In some embodiments, the surface 112 is coupled to one or more motors or similar element which causes motion in the surface 112. For example, the motors may adjust the speed of the surface grate 112 and/or imparts a vibratory movement to the surface grate 112 which causes the solid fuel 102 to move along the surface grate 112. In some other embodiments, the surface grate 112 is stationary.

The furnace 110 also has typically two or more air inlets, including at least an underfire air inlet 114 and optionally an overfire air inlet 116 The air inlets 114, 116 are configured for providing air or other oxidant elements to the furnace 110, thereby aiding the combustion of the solid fuel 102. The underfire air inlet 114 may be located at any suitable location under or within the surface grate 112, and thus below or approximately level with the combustion process of the solid fuel 102. In some embodiments, the underfire air inlet 114 impinges substantially directly on the surface grate 112. The overfire air inlet 116 may be located at any suitable location above the combustion process of the solid fuel 102. In some embodiments, each of the air inlets 114, 116 is a series of air inlets. For example, the overfire air inlet 116 may include a plurality of air inlets located at different positions within the furnace 110. In some embodiments, the air inlets 114, 116 are provided with dampers, which may be manual or automatic, for adjusting the air flow into the furnace 110. In some embodiments, the overfire air inlet 116 is eschewed.

The furnace 110 also has one or more air outlets, including at least a flue gas outlet 118. The flue gas outlet 118 provides a venting path for fumes and other gases produced by the combustion of the solid fuel 102, collectively called "flue gas", to vent from the furnace 110. In some embodiments, the flue gas outlet 118 vents the flue gas to an outside environment. In some other embodiments, the flue gas outlet 118 vents the flue gas to a subsequent processing stage or system. For example, part or all of the flue gas is used as part of further heat recovery processes. In another example, the flue gas is processed to remove certain chemicals or particulates found therein before being vented to the outside environment. In some embodiments, the flue gas outlet 118 is a plurality of flue gas outlets located at various positions about the furnace 110.

Located within and proximate to the solid-fuel heat generator system 100 are a plurality of sensors 140. The sensors 140 are used to track, measure, and control various data points regarding characteristics of the components of the solid-fuel heat generator system 100, including the furnace 110, the boiler 120, and the steam distribution system 130. Some of the sensors 140 may be used to infer fuel input characteristics, measure changes heat input-to-output balance, track characteristics of the surface grate 112, for example the relative height of the solid fuel 102 on the surface grate 112 by measuring the differential pressure between the base of the grate 112 and the furnace 110, a temperature of the surface grate 112 or in the vicinity of the surface grate 112, and the like. In addition, some of the sensors 140 may be used to measure a pressure level in the boiler drum 122, a rate of steam flow through steam outlet 124, and the like. Still other types of sensors are considered.

The solid-fuel heat generator system 100 is also provided with a control system 150 which regulates the operation of the solid-fuel heat generator system 100 based on information collected by the sensors 140 and other inputs, for instance from a control interface used by one or more operators of the solid-fuel heat generator system 100. In some embodiments, the control system 150 is communicatively coupled to the sensors 140 to obtain data from the sensors about the characteristics of the solid-fuel heat generator system 100. In other embodiments, the sensors 140 are communicatively coupled to the control interface or another high-level central controller, which then provides the control system 150 with the necessary information.

The control system 150 regulates the operation of the solid-fuel heat generator system 100 with the aim of causing the boiler 120 to produce steam at a substantially stable and constant rate based on a desired level of demand for steam. Stable and controllable steam generation by the boiler 120 means reliable steam delivery to the steam distribution system 130. This, in turn, means that the amount of steam available to the steam distribution system 130 is not constrained by the ability of the solid fuel steam generator 100 to follow the total steam demand set by the different turbines and heat sinks. To do this, the control system 150 is configured to alter the combustion process within the furnace 110 to maintain an instantaneous heat release (IHR) at target and to attenuate any uncontrolled heat release variations.

Figure 2:
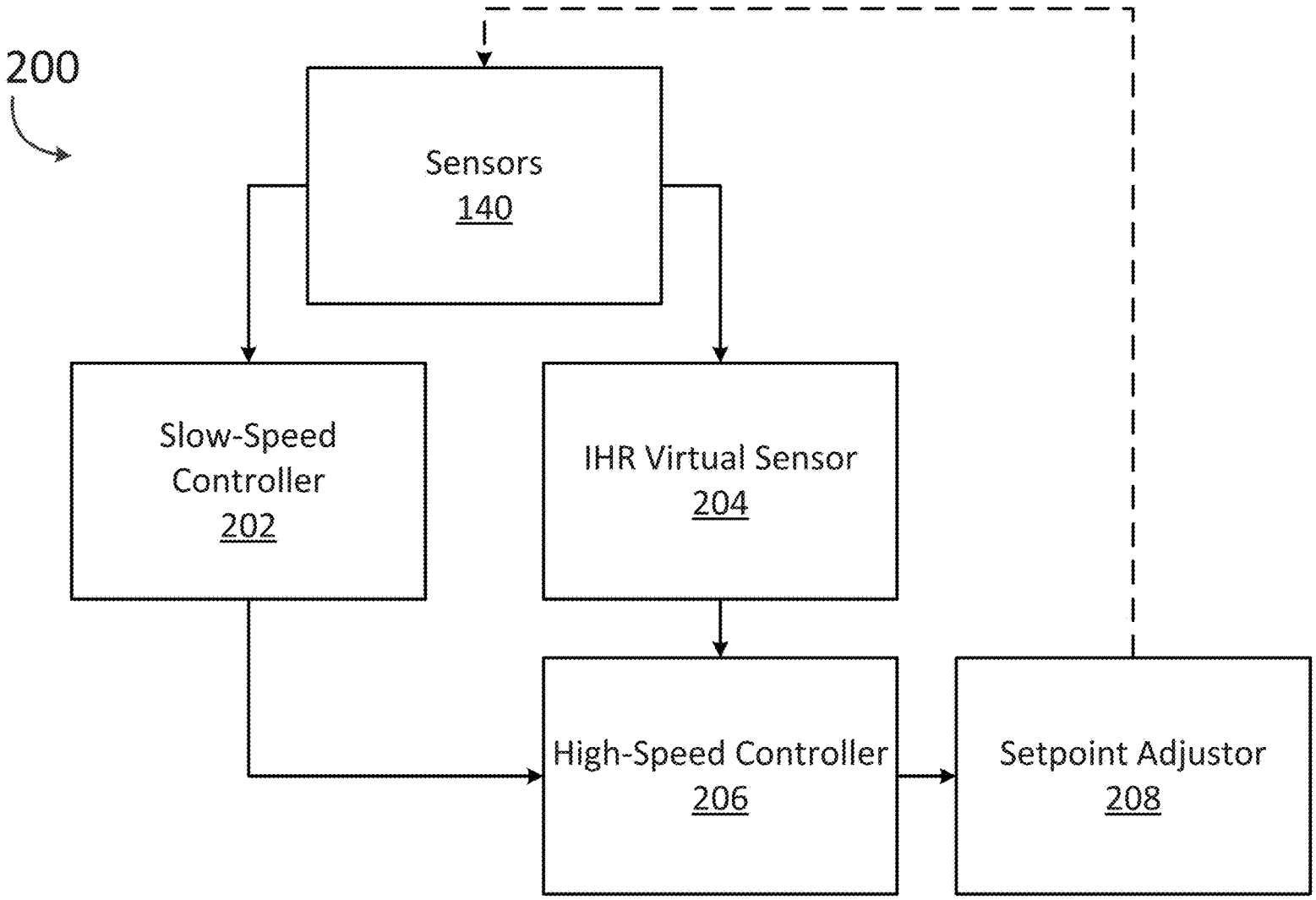
FIG. 2 is a diagram of a control system for modulating a solid-fuel-based combustion process in accordance with an embodiment.

With reference to FIG. 2, there is shown a diagram of a control system 200 for modulating a solid-fuel based combustion process. The control system 200 may, for example, be an implementation of the control system 150. The control system 200 includes a slow-speed controller 202, an IHR virtual sensor 204, a high-speed controller 206, and a setpoint adjustor 208.

The slow-speed controller 202 is configured for obtaining a first set of sensor values from one or more of the sensors 140, and may include steam flow, steam drum pressure, and the like. The slow-speed controller 202 measures an energy level of the steam header system 130, for example based on the steam pressure.

The IHR virtual sensor 204, receives a current firing rate demand for the furnace 110 from the slow-speed controller 202 based on the first set of sensor values. In some embodiments, the current firing rate demand is established as a requisite value for the IHR for the furnace 110. The IHR demand of the furnace 110 is the total required amount of instantaneous heat to be produced by the combustion of the solid fuel 102 in the furnace 110.

The IHR virtual sensor 204 is configured for obtaining a second set of sensor values from one or more of the sensors 140, and may include furnace temperature, furnace pressure, flue gas composition, drum temperature, drum pressure, and the like. In some embodiments, the IHR virtual sensor 204 calculates an estimation of the process IHR for the furnace 110 based on the second set of sensor values.

In order to measure or estimate the IHR, the IHR virtual sensor 204 is used to produce a value for the current IHR based on a variety of information, including that received from the sensors 140. In some embodiments, the IHR virtual sensor 204 determines the IHR based on a rate of steam flow from the boiler 120 and a pressure in the boiler drum 122. For example, the IHR can be expressed via the following equation:

$$IHR = F_{steam} + K \cdot \frac{dP_{drum}}{dt}$$

where $F_{steam}$ is a steaming rate of the boiler 120 (e.g. in units of mass over time), K is a predetermined constant, and $$\frac{dP_{drum}}{dt}$$

is a pressure differential for the boiler drum 122 (e.g. in units of pressure over time). In some embodiments, K is selected so that any variation in the steaming rate caused by pressure changes downstream of the boiler 120, for example in the steam distribution system 130, are discarded as false indications of heat release change. For example, a more complex formula for IHR, with one or more non-linear parameters and where variables and rates-of-change of variables are combined dynamically, may be used. In another example, a neural network or other machine-learning system is used within the virtual sensor to compute and estimate a process value for IHR that can be used as one or more control variables based on the target IHR received by the slow-speed controller 202.

In some embodiments, the IHR virtual sensor 204 uses additional information to determine the IHR. For example, the chemical composition of the flue gas expelled at the flue gas outlet 118, for instance a concentration of $O_2$ therein, is used as an additional factor for the IHR virtual sensor 204. In another example, a temperature of the surface 112 and/or a mass distribution of solid fuel 102 on the surface 112 is used as an additional factor for the IHR virtual sensor 204. Still other factors may be used to supplement or augment the IHR virtual sensor 204, including any of the factors listed hereinabove.

The high-speed controller 206, is configured for receiving the current firing rate demand from the slow-speed controller 202 and the IHR from IHR virtual sensor 204. In some embodiments, the high-speed controller is configured for operating in substantially real-time for instance at least at an execution rate faster than 5 seconds. In some embodiments, the firing rate demand is representative of a requisite value for the IHR of the furnace 110. The firing rate demand and the IHR may be provided in any suitable format, and may be received by the second controller via any suitable wired or wireless means. In some embodiments, the second controller is provided with a default firing rate demand which remains substantially unchanged, for example because of long response times for steam pressure and steam flow to changes in air flow and fuel input, and thus steps 202 and 204 may be skipped.

The high-speed controller 206 is also configured to compare the IHR, obtained from the IHR virtual sensor 204, to the current firing rate demand obtained from the slow-speed controller 202. Changes in the IHR vis-à-vis the firing rate demand occur as the combustion process takes place within the furnace 110, and may be attributable to a variety of factors that are either difficult or impractical to measure directly. However, measurable effects throughout the solid-fuel heat generator system 100 can serve as a proxy for determining or estimating the IHR and/or changes in the IHR, via the virtual sensor. In some embodiments, the high-speed controller 206 is also configured for projecting changes in the IHR and/or to establish trends in the IHR based on one or more past values of the IHR.

For example, changes in the IHR results in changes in the flue gas composition ($H_2O$, concentration of excess $O_2$, CO, $NO_x$, and the like) and a furnace temperature profile, for instance from the combustion site at the surface 112 up to the flue gases at the flue gas outlet 118. Additionally, heat transfer differences may be observed, for instance through energy balance calculations, at later elements like steam superheaters, economizers, air heaters, or other heat exchangers using flue gases.

In addition, changes in the IHR result in several measurable effects within the boiler 120, for instance changes in the pressure and/or temperature in the boiler drum 122, steaming production rate of the boiler 120, and a water level in the boiler drum 122. For example, an increase in the IHR will vaporize some water contained in the boiler drum 122, causing a measurable increase in a level of steam in the boiler drum 122, a change in the pressurization of the boiler drum 122, as well as an increased steaming rate by the boiler 120. Conversely, a reduction in heat release depressurizes the boiler drum 122, causes a shrink of the level of water in the boiler drum 122 due to the sudden reduction of steam volume within the bank, and decreases the steaming rate of the boiler 120.

In some embodiments, the high-speed controller 206 also compares the current IHR to at least one previously-determined IHR. In some embodiments, the comparison is measured in terms of a relative variation of the current IHR with respect to the previously-measured IHR. In other embodiments, the comparison is measured in terms of an absolute variation of the current IHR vis-à-vis the previously-measured IHR. Still other comparisons are considered.

The setpoint adjustor 208 is configured for receiving instructions from the high-speed controller 206 for adjusting the underfire air flow, provided by the underfire air inlet 114, based on the comparison between the IHR and the current firing rate demand, or any other suitable factors, as performed by the second controller. By adjusting the underfire air flow, the combustion process of the solid fuel 102 is altered, thereby adjusting the IHR to compensate for deviations in the IHR.

For example, if the high-speed controller 206 determines that the IHR is lower than the current firing rate demand, for instance as set by the first controller, the underfire air flow is rapidly increased, forcing more air into the solid fuel 102, that will lead to an increased combustion reaction and heat release. Conversely, if the IHR is over the firing rate demand, for instance as set by the first controller, the underfire air flow is rapidly decreased to reduce the amount of oxygen flowing to the solid fuel 102 thereby reducing the combustion inside the furnace.

In some embodiments, a certain tolerance for the IHR is allowed to the high-speed controller 206. For example, the IHR is only considered to require adjustment of the underfire air flow when current IHR strays from the current firing rate demand by more than a predetermined tolerance. The predetermined tolerance may be a percent deviation, a number of standard deviations, or any other suitable value.

Optionally, the setpoint adjustor 208 is configured for adjusting one or more other operating characteristics of the solid-fuel heat generator system 100 based on the current IHR. This may include adjusting the overfire air flow rate provided by the overfire air inlet 116, adjusting the rate of flow of solid fuel 102 to the furnace 110, and/or a rate of movement of the surface 112 when the level of fluctuation does not correspond to the current firing rate demand. For example, when the surface 112 is a grate, a rate of vibration of the grate is adjusted by the setpoint adjustor 208. In another example, when the overfire air inlet 116 includes a recycled flue gas inlet, the rate of flow of recycled flue gas is adjusted by the setpoint adjustor 208. Still other embodiments are considered.

In some embodiments, the underfire air flow and optionally other operating characteristics of the solid-fuel heat generator system 100 are substantially continuously adjusted in response to the IHR and/or changes in the current firing rate demand. The control system 200 is configured for iteratively adjusting the various setpoints of the furnace 110 in response to further changes to the IHR and/or the current firing rate demand. For example, a subsequent firing rate demand can be obtained, and the control system 200 further adjust the underfire air flow and optionally the other operating characteristics of the solid-fuel heat generator system 100 based on further changes to the IHR. Changes to the IHR occur following changes to the fuel burning process, and due to some adjustments performed by the setpoint adjustor 208.

In some embodiments, the control system 200 operates periodically at any suitable interval. For example, the operation of the control system 200 is repeated several times per second, every second, every few seconds, several times per minute, every minute, every few minutes, several times per hour, every hour, every few hours, several times per day, or at any other suitable interval. In some other embodiments, the control system 200 is operated in response to the control system 200 receiving a request to perform various operations, or any other suitable trigger.

In some embodiments, a minimum time delay between the previously-determined IHRs and the current IHR is set. The time delay may be used to ignore or filter process variables 140 to validate them and eliminate outliers for their use as input variables when determining the current level of fluctuation.

The control system 200 provides a rapid feedback loop which may be used to stabilize the heat release of the biomass combustion system 100 by adjusting the underfire air flow provided by the underfire air inlet 114, and optionally other operational parameters, based on the fluctuation of the IHR. The method 200 may reduce the short-term variability of steam production. In some embodiments, the method 200 is used to adjust the operation of the solid-fuel heat generator system 100 on a scale of minutes, for instance having a closed-loop time constant of less than two minutes.

Figure 3:
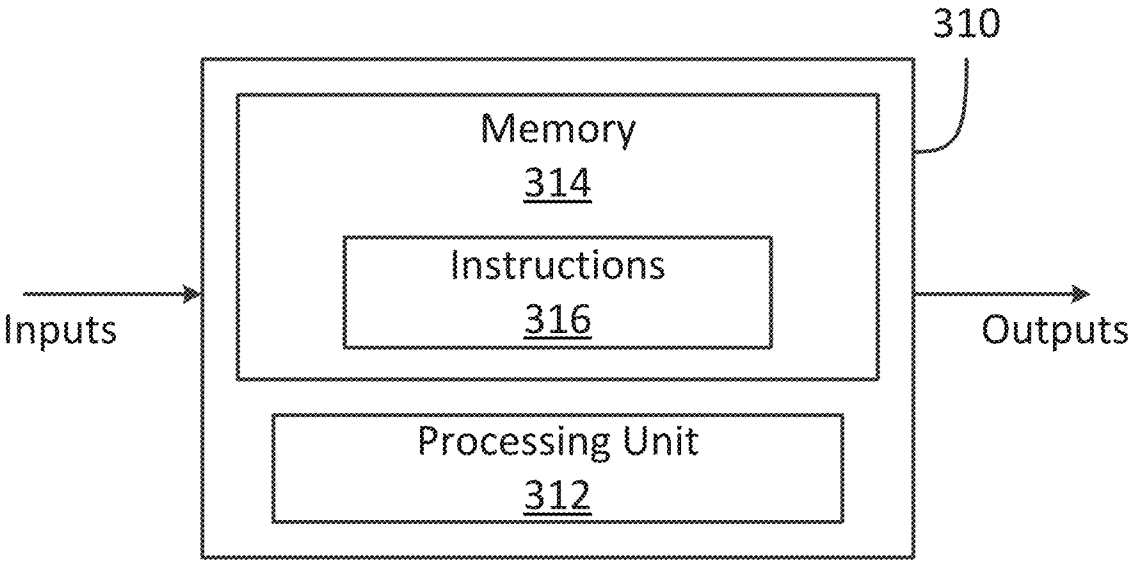
FIG. 3 is a block diagram of an example computing system.

With reference to FIG. 3, the control systems 150 and 200 may be implemented by a computing device 310, comprising a processing unit 312 and a memory 314 which has stored therein computer-executable instructions 316. The processing unit 312 may comprise any suitable devices configured to cause a series of steps to be performed so as to implement the functionality of the control systems 150 and 200, such that instructions 316, when executed by the computing device 310 or other programmable apparatus, may cause the functions/acts/steps specified in the methods described herein to be executed. The processing unit 312 may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory 314 may comprise any suitable known or other machine-readable storage medium. The memory 314 may comprise non-transitory computer readable storage medium such as, for example, but not limited to, an electronic, magnetic, optical, electromagnetic, infrared, or semiconductor system, apparatus, or device, or any suitable combination of the foregoing. The memory 314 may include a suitable combination of any type of computer memory that is located either internally or externally to device such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. The memory 314 may comprise any storage means (e.g., devices) suitable for retrievably storing the computer-executable instructions 316 executable by processing unit 312.

It should be noted that various types of computer systems and logic approaches may be employed, as appropriate. This includes fuzzy logic, deviation, model predictive controllers, adaptive PID control, and the like. Additionally, any suitable type of machine learning or artificial intelligence system may be used, including both supervised and unsupervised neural networks, and the like.

Figure 4:
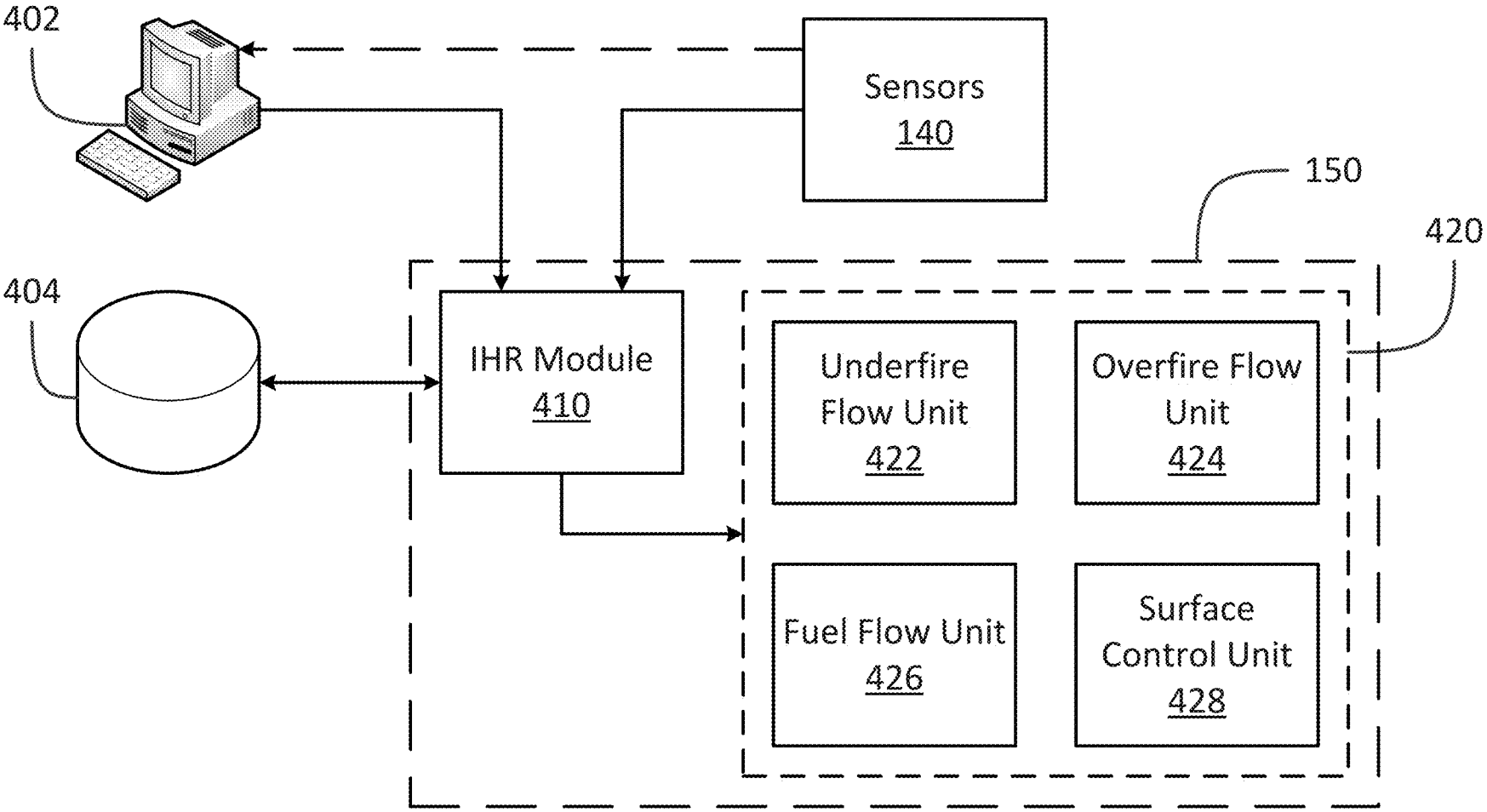
FIG. 4 is a block diagram of an example control system for the solid-fuel heat generator system of FIG. 1.

With reference to FIG. 4, an embodiment of the control system 150 is configured to interface with the sensors 140, a control interface 402, and a database or other storage medium 404. The sensors 140 are configured for obtaining information about the operating characteristics of the solid-fuel heat generator system 100 and for providing the information to the control system 150, and optionally to the control interface 402. The control interface 402 is configured for providing the control system 150 with the firing rate demand, and optionally with the information from the sensors 140. The database 404 is configured for storing an array of previously-determined IHR, past control actions, for receiving and storing the current IHR, and for providing the previously-determined IHR to the control system 150.

The control system 150 includes an IHR module 410 and an adjustment module 420. The adjustment module 420 may be provided with a plurality of units which are each configured for adjusting the operation of a particular element of the solid-fuel heat generator system. For example, the adjustment module 420 includes an underfire flow unit 422, which controls the rate of underfire air flow via the underfire air inlet 114, an overfire flow unit 424, which controls the rate of overfire air flow via the overfire air inlet 116, a fuel flow unit 426, which controls the rate of flow of solid fuel 106 to the furnace 110, and a surface control unit 428, which controls the movement of the surface 112. In other examples, the adjustment module 420 may include fewer units, or additional units, as appropriate.

The IHR module 410 is configured for optionally receiving the current firing rate demand, for example from the control interface 402. The fluctuation module 410 may receive the current firing rate demand over any suitable wired or wireless communication path, and in any suitable format.

The IHR module 410 is also configured for determining the current IHR and the previously-determined IHR. The IHR module 410 uses the information received from the sensors 140 and/or the control interface 402 to determine the current IHR and, optionally obtains the previously-determined IHR from the database 404. The IHR module 410 then compares the current IHR with the current firing rate demand, and any other values, as appropriate.

When the current IHR does not correspond to the current firing rate demand, the IHR module 410 sends an indication to the adjustment module 420 and instructs the adjustment module 420 to adjust the underfire air flow. The adjustment module 420, via the underfire air unit 422, adjusts the underfire air flow in response to the indication received from the fluctuation module 410, as per step 208.

Optionally, the indication from the IHR module 410 to the adjustment module 420 also instructs the adjustment module 420 to adjust other operational parameters of the solid-fuel heat generator system 100. The adjustment module 420 then effects the changes to the operational parameters of the solid-fuel heat generator system 100 via the appropriate units 424, 426, 428. For example, the adjustment module 420 effects a change to the overfire air flow via the overfire flow unit 424. In another example, the adjustment module 420 effects a change in the rate of vibration of the grate in the furnace 110 via the surface control unit 428.

Figure 5:
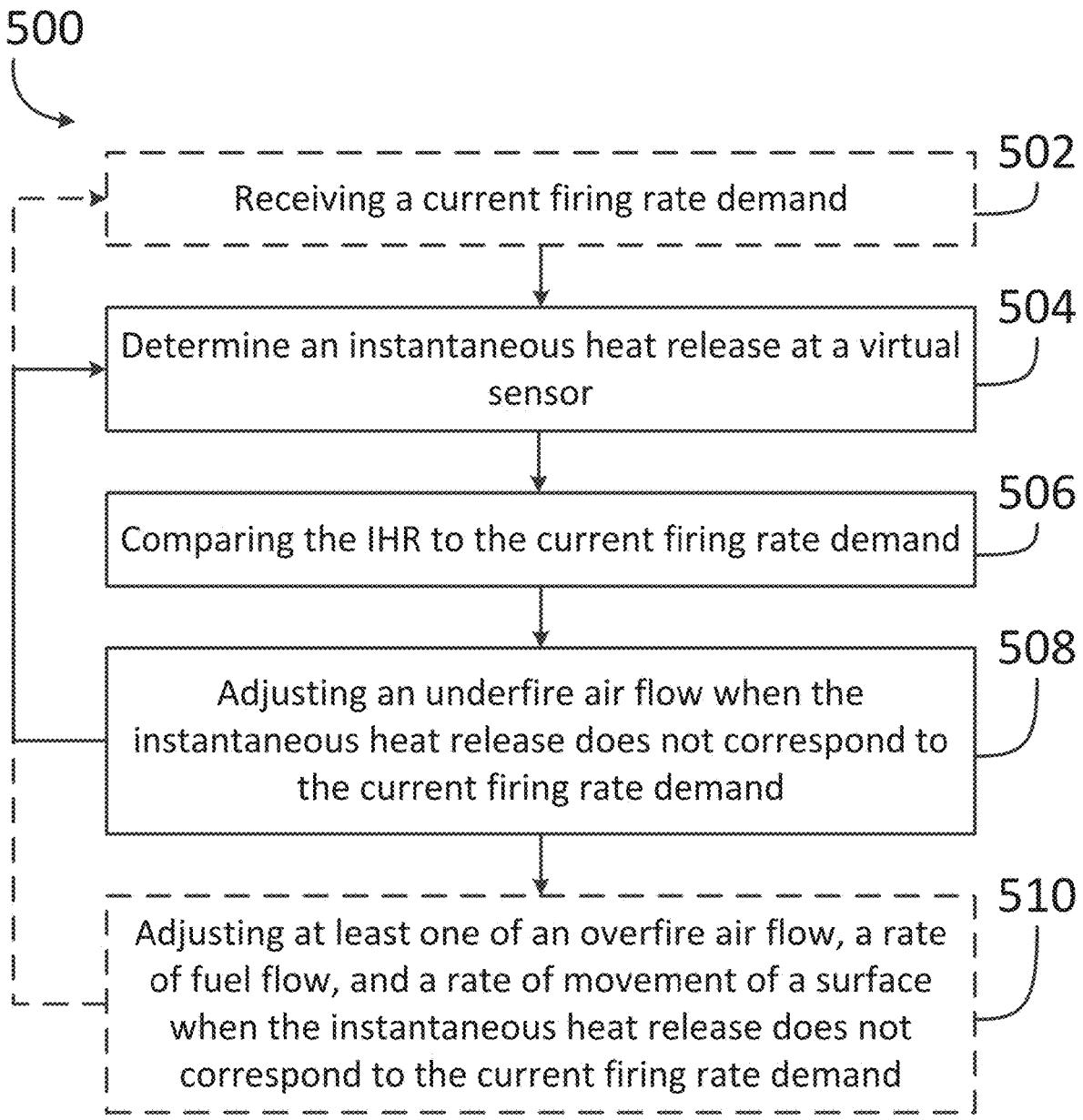
FIG. 5 is a flowchart illustrating an example method for modulating a solid-fuel-based combustion process according to an embodiment.

With reference to FIG. 5, in some embodiments the IHR virtual sensor 204 and the high-speed controller 206 collaborate to implement a method 500. It should be noted that in other embodiments, the method 500 is implemented by more or fewer components.

At step 502, optionally a current firing rate demand is received. At step 504, an IHR is determined via a virtual sensor. At step 506, the IHR is compared to the current firing rate demand. At step 508, an underfire air flow is adjusted when the instantaneous heat release does not correspond to the current firing rate demand. At step 510, at least one of overfire air flow, a rate of fuel flow, and a rate of movement of a surface is adjusted when the instantaneous heat release does not correspond to the current firing rate demand.

The methods and systems for modulating a solid-fuel-based combustion process described herein may be implemented in a high-level procedural or object-oriented programming or scripting language, or function block logic, or ladder logic, or state-based algorithms, or a combination thereof, to communicate with or assist in the operation of a computer system, for example the computing device 310. Alternatively, the methods and systems for modulating a solid-fuel-based combustion process described herein may be implemented in assembly or machine language. The language may be a compiled or interpreted language. Program code for implementing the methods and systems for generating solid-fuel-based energy described herein may be stored on a storage media or a device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein. Embodiments of the methods and systems for modulating a solid-fuel-based combustion process described herein may also be considered to be implemented by way of a non-transitory computer-readable storage medium having a computer program stored thereon. The computer program may comprise computer-readable instructions which cause a computer, or more specifically the at least one processing unit of the computer, to operate in a specific and predefined manner to perform the functions described herein.

Computer-executable instructions may be in many forms, including program modules, executed by one or more computers or other devices. Generally, program modules include routines, programs, objects, components, data structures, etc., that perform particular tasks or implement particular abstract data types. Typically the functionality of the program modules may be combined or distributed as desired in various embodiments.

Various aspects of the methods and systems for modulating a solid-fuel-based combustion process disclosed herein may be used alone, in combination, or in a variety of arrangements not specifically discussed in the embodiments described in the foregoing and are therefore not limited in their application to the details and arrangement of components set forth in the foregoing description or illustrated in the drawings. For example, aspects described in one embodiment may be combined in any manner with aspects described in other embodiments. Although particular embodiments have been shown and described, it will be obvious to those skilled in the art that changes and modifications may be made without departing from this invention in its broader aspects. The scope of the following claims should not be limited by the preferred embodiments set forth in the examples, but should be given the broadest reasonable interpretation consistent with the description as a whole.

What is claimed is:

1. A method for modulating a solid-fuel-based combustion process, comprising:

determining, using a virtual sensor, a current instantaneous heat release for a solid-fuel-based heat generator based on at least two sensor values, the at least two sensor values comprising a flow rate of steam produced by the heat generator and a steam drum pressure differential over time in the heat generator;

at a high-speed heat release controller in cascade connection with a slow-speed heat release controller comprising one of a steam flow controller and a steam pressure controller, receiving the current instantaneous heat release from the virtual sensor and comparing the current instantaneous heat release to a current firing rate demand received from the slow-speed controller; and when the current instantaneous heat release does not correspond to the current firing rate demand, causing at the high-speed controller, an underfire air flow of and a rate of fuel flow to the heat generator to be adjusted with a closed-loop time constant of less than two minutes to minimize a difference between the current instantaneous heat release and the current firing rate demand.

2. The method of claim 1, wherein the current instantaneous heat release is further based on at least one of a composition of a flue gas output by the heat generator, a temperature profile for the heat generator, a heat transfer differential measured between first and second points within the heat generator, and a parameter of a water drum associated with the heat generator.

3. The method of claim 1, further comprising adjusting an overfire air flow of the heat generator when the current instantaneous heat release does not correspond to the current firing demand.

4. The method of claim 1, further comprising adjusting a rate of vibration of a grate of the heat generator when the current instantaneous heat release does not correspond to the current firing demand.

5. The method of claim 1, wherein comparing the current instantaneous heat release to the current firing rate demand comprises determining whether the difference between the current instantaneous heat release and the current firing demand is beyond a predetermined tolerance; and wherein the current instantaneous heat release not corresponding to the current firing demand comprises the difference being beyond the predetermined tolerance.

6. The method of claim 1, further comprising:

receiving a subsequent firing rate demand;

determining a subsequent instantaneous heat release;

comparing the subsequent instantaneous heat release with the subsequent firing rate demand; and when the subsequent instantaneous heat release does not correspond to the subsequent current firing demand, adjusting the underfire airflow of the heat generator.

7. The method of claim 6, wherein determining the instantaneous heat release is further based on the at least one previously-determined instantaneous heat release.

8. The method of claim 1, wherein causing the underfire air flow of the heat generator to be adjusted comprises increasing the underfire air flow of the heat generator when the current instantaneous heat release is lower than the current firing rate demand, and decreasing the underfire air flow of the heat generator when the current instantaneous heat release is greater than the current firing rate demand.

9. A system for modulating a solid-fuel-based combustion process, comprising:

a processing unit; and a non-transitory computer-readable memory having stored thereon program instructions executable by the processing unit for:

determining, using a virtual sensor, a current instantaneous heat release of a solid-fuel-based heat generator based on at least two sensor values, the at least two sensor values comprising a flow rate of steam produced by the heat generator and a steam drum pressure differential over time in the heat generator;

at a high speed heat release controller in cascade connection with a slow-speed heat release controller comprising one of a steam flow controller and a steam pressure controller, receiving the current instantaneous heat release from the virtual sensor and comparing the current instantaneous heat release to a current firing rate demand received from the slow-speed controller; and when the current instantaneous heat release does not correspond to the current firing rate demand, causing, at the high-speed controller, an underfire air flow of and a rate of fuel flow to the heat generator, to be adjusted with a closed-loop time constant of less than two minutes to minimize a difference between the current instantaneous heat release and the current firing rate demand.

10. The system of claim 9, wherein the current instantaneous heat release is further based on at least one of a composition of a flue gas output by the heat generator, a temperature profile for the heat generator, a heat transfer differential measured between first and second points within the heat generator, and a parameter of a water drum associated with the heat generator.

11. The system of claim 9, the program instructions being further executable for adjusting an overfire air flow of the heat generator when the current instantaneous heat release does not correspond to the current firing demand.

12. The system of claim 9, the program instructions being further executable for adjusting a rate of vibration of a grate of the heat generator when the current instantaneous heat release does not correspond to the current firing demand.

13. The system of claim 9, wherein comparing the current instantaneous heat release to the current firing rate demand comprises determining whether the difference between the current instantaneous heat release and the current firing demand is beyond a predetermined tolerance; and wherein the current instantaneous heat release not corresponding to the current firing demand comprises the difference being beyond the predetermined tolerance.

14. The system of claim 9, the program instructions being further executable for:

receiving a subsequent firing rate demand;

determining a subsequent instantaneous heat release;

comparing the subsequent instantaneous heat release with the subsequent firing rate demand; and when the subsequent instantaneous heat release does not correspond to the subsequent current firing demand, adjusting the underfire airflow of the heat generator.

15. The system of claim 14, wherein determining the subsequent instantaneous heat release is further based on the at least one previously-determined instantaneous heat release.

16. The system of claim 9, wherein the program instructions are executable for increasing the underfire air flow of the heat generator when the current instantaneous heat release is lower than the current firing rate demand, and for decreasing the underfire air flow of the heat generator when the current instantaneous heat release is greater than the current firing rate demand.

* * * * *